US008181495B2

(12) United States Patent
Kiest et al.

(10) Patent No.: US 8,181,495 B2
(45) Date of Patent: May 22, 2012

(54) ANTI-THEFT DEVICE AND METHOD FOR FUEL DISPENSERS

(75) Inventors: Terence Brian Kiest, Highland, IN (US); Michael Steven Kiest, Porter, IN (US); Michael Anthony Hawley, Highland, IN (US)

(73) Assignee: Northern Indiana Mechanical, Inc., Gary, IN (US)

( * ) Notice: Subject to any disclaimer, the term of this patent is extended or adjusted under 35 U.S.C. 154(b) by 315 days.

(21) Appl. No.: 12/566,035

(22) Filed: Sep. 24, 2009

(65) Prior Publication Data

US 2010/0071422 A1 Mar. 25, 2010

Related U.S. Application Data

(60) Provisional application No. 61/099,748, filed on Sep. 24, 2008.

(51) Int. Cl.
*E05B 73/00* (2006.01)

(52) U.S. Cl. ..... 70/18; 70/78; 70/158; 70/77; 70/163

(58) Field of Classification Search ..... 70/78, 159, 70/160, 161, 55, 162, 15, 77, 428, 163, 424, 70/56, 423, 427, 164, 18, 54, 158; 137/343; 292/259 R; 312/137
See application file for complete search history.

(56) References Cited

U.S. PATENT DOCUMENTS

| | | | | | |
|---|---|---|---|---|---|
| 3,665,736 | A * | 5/1972 | Wilson | 70/78 |
| 4,028,913 | A * | 6/1977 | Falk | 70/58 |
| 4,418,551 | A * | 12/1983 | Kochackis | 70/18 |
| 5,052,198 | A * | 10/1991 | Watts | 70/58 |
| 5,257,581 | A * | 11/1993 | Welling | 292/259 R |
| 5,826,853 | A * | 10/1998 | Anello et al. | 70/161 |
| 6,962,067 | B1 * | 11/2005 | Chapman | 70/18 |
| 7,661,733 | B1 * | 2/2010 | Angel | 292/259 R |
| 2007/0109068 | A1 * | 5/2007 | Smith et al. | 333/1.1 |
| 2007/0164573 | A1 * | 7/2007 | Reimer et al. | 292/259 R |

* cited by examiner

*Primary Examiner* — Lloyd Gall
*Assistant Examiner* — David E Sosnowski
(74) *Attorney, Agent, or Firm* — Hartman & Hartman P.C.; Gary M. Hartman; Domenica N. S. Hartman

(57) ABSTRACT

An anti-theft device and method for securing and preventing access to components within an interior of a fuel dispenser cabinet having an access door located on one side of the cabinet. The device includes structure for securing the anti-theft device to the periphery of the cabinet, structure for preventing the anti-theft device from being laterally and vertically removed from the cabinet, and a releasable assembly for selectively allowing and preventing access to the interior of the cabinet through the door.

20 Claims, 2 Drawing Sheets

ANTI-THEFT DEVICE AND METHOD FOR FUEL DISPENSERS

CROSS REFERENCE TO RELATED APPLICATIONS

This application claims the benefit of U.S. Provisional Application No. 61/099,748, filed Sep. 24, 2008, the contents of which are incorporated herein by reference.

BACKGROUND OF THE INVENTION

The present invention generally relates to devices capable of securing and preventing access to the interior components of fuel dispensers, for example, of the types found at gas stations and especially the large commercial plazas frequented by interstate travelers.

Fuel dispensers generally comprise a cabinet that defines a closed interior containing components that deliver and meter the fuel being dispensed, and display the amount and cost of the dispensed fuel. A door is typically provided through which the interior of the dispenser can be accessed for repairs and maintenance. If access can be gained to the interior of the dispenser, an individual can obtain fuel illegally by damaging the dispenser metering components, and particularly by removing or damaging a pulser within the dispenser that calculates the fuel sale from the dispenser. Consequently, devices referred to as pulser guards have been installed within fuel dispensers to physically protect the pulser. However, pulser guards are ineffective if an individual realizes that, by gaining access to the interior of the dispenser through the door, they can tamper with or sufficiently damage the pulser guard so that the pulser can still be removed or damaged.

BRIEF DESCRIPTION OF THE INVENTION

The present invention provides an anti-theft device and method for securing and preventing access to components within an interior of a fuel dispenser cabinet having upper and lower margins, sides defining a periphery of the cabinet, and an access door located in one of the sides of the cabinet.

According to a first aspect of the invention, the anti-theft device includes means for securing the anti-theft device to the periphery of the cabinet, means for preventing the anti-theft device from being laterally and vertically removed from the cabinet, and releasable means for selectively allowing and preventing access to the interior of the cabinet through the door located on a side of the cabinet. In a preferred embodiment, the anti-theft device is secured and prevented from being removed by configuring the device to comprise first and second frame units, each comprising a pair of legs and at least a first cross-member joined and oriented transverse to the pair of legs, and at least a second cross-member that couples the first and second frame units together. Furthermore, the releasable means preferably comprises the second cross-member, a first end of which is pivotably coupled to the first frame unit and a second end is releasably coupled to the second frame unit. Finally, means is provided for locking the second end of the second cross-member to the second frame unit.

According to another aspect of the invention, the method entails securing the anti-theft device to the periphery of the cabinet, preventing the anti-theft device from being laterally and vertically removed from the cabinet, and selectively allowing and preventing access to the interior of the cabinet through the door located on the side of the cabinet.

In view of the above, the invention is capable of securing and preventing access to the interior components of fuel dispensers, for example, of the types found at gas stations and especially the large commercial plazas frequented by interstate travelers, so that individuals cannot gain access to the interior of the dispenser and remove or damage the pulser or other metering components within the dispenser for the purpose of illegally obtaining fuel from the dispenser.

Other aspects and advantages of this invention will be better appreciated from the following detailed description.

DETAILED DESCRIPTION OF THE INVENTION

Figure 1:
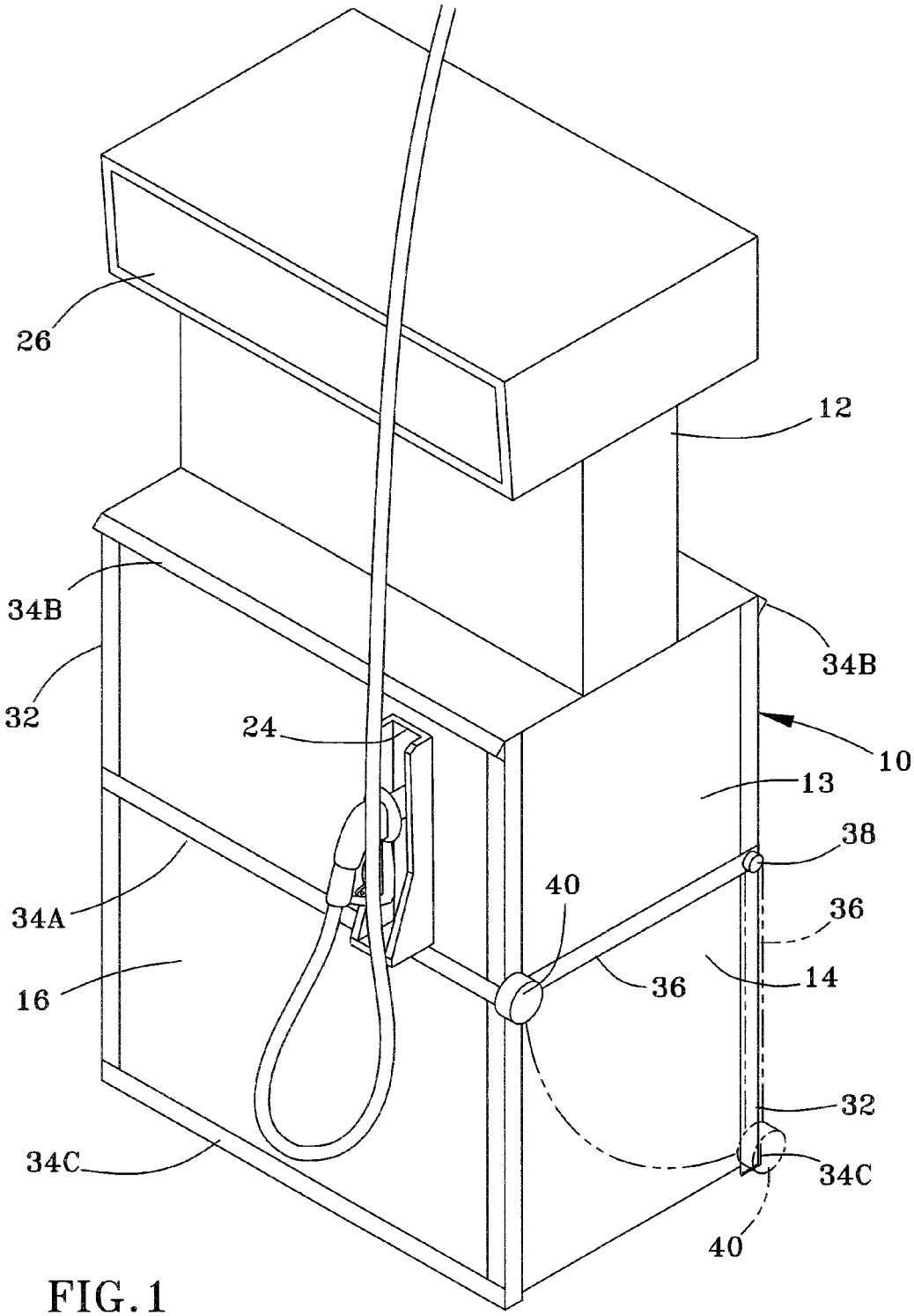
FIGS. 1 and 2 are perspective and side views, respectively, of an anti-theft device installed on a fuel dispenser in accordance with an embodiment of this invention.
Figure 2:
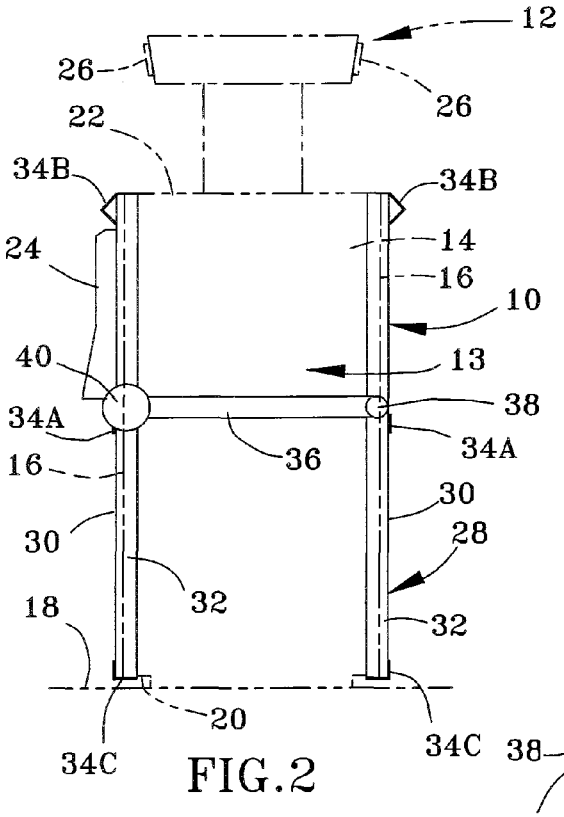

FIGS. 1 through 4 depict an anti-theft device 10 adapted for protecting interior components of a fuel dispenser 12, and particularly the removal of or damage to the pulser (not shown) or any other metering components within a cabinet 13 of the dispenser 12. To facilitate the description of the device 10, the terms "vertical," "horizontal," "front," "rear," "side," "upper," "lower," "above," "below," "right" and "left" are used in reference to the drawings and the installation of the dispenser 12 depicted in the drawings. FIGS. 1 and 2 depict the dispenser 12 as a generic fuel dispenser, and it should be understood that installations on various types of fuel dispensers are also within the scope of the invention.

Shown in FIGS. 1 and 2, the dispenser cabinet 13 is generally configured to define an outer periphery formed by outer wall panels 14 and one or more doors 16 that allow access to the interior of the cabinet 13. One door 16 is visible in FIG. 1 on one of the wider sides of the cabinet 13, while a second door 16 is typically located on the opposite wider side of the cabinet 13. The doors 16 may be configured as panels that can be completely removed from the cabinet 13 or equipped with hinges to open by swinging out and away from the cabinet 13, though other configurations are also possible and within the scope of the invention. The two narrower sides of the cabinet 13 are represented as defined by panels 14 that are not configured as doors or otherwise removable, but instead are permanently attached with fasteners (not shown) or other means to the underlying framework of the cabinet 13. Other configurations for the cabinet 13, including different quantities and locations for the panels 14 and doors 16, are also possible and within the scope of the invention. The dispenser 12 is adapted for being secured to a foundation 18, and the lower extents of the wall panels 14 define a lower margin 20 of the cabinet 13 spaced above the foundation 18. In a similar manner, the upper extents of the wall panels 14 also define an upper margin 22 of the cabinet 13.

As evident from the Figures, the anti-theft device 10 comprises a frame assembly 28 sized and configured to surround the outer periphery of the fuel cabinet 13 in a manner that secures the outer wall panels 14 and doors 16, thus preventing the removal of the panels 14 and doors 16 and preventing access to the interior of the cabinet 13. The frame assembly 28 is represented as comprising two substantially identical frame units 30 that are installed on opposite sides of the cabinet 13, preferably on the wider sides of the cabinet 13 where the fuel nozzle carriages 24 (one of which is shown) and dispenser displays 26 are located in FIGS. 1 and 2. Each frame unit 30 is shown as comprising a pair of vertical legs 32 and three cross-members 34A, 34B and 34C. The quantities and locations of the legs 32 and cross-members 34A-C can differ from what is shown in the Figures. The legs 32 and the upper and lower cross-members 34B and 34C are represented as being constructed of angle iron (or any other suitable material), and the remaining cross-members 34A are represented as being formed of flatstock. The choice of forming the legs 32 and cross-members 34A-C from angle or flatstock will depend on the particular construction of the cabinet 13, though certain advantages will be described below for the legs 32 and cross-members 34A-C when formed of either angle or flat stock. The cross-members 34A-C are preferably joined by welding (or any other suitable joining or attachment technique) to the legs 32, such that each frame unit 30 has a solid one-piece construction that cannot be disassembled without cutting the legs 32 and cross-members 34A-C.

Figure 3:
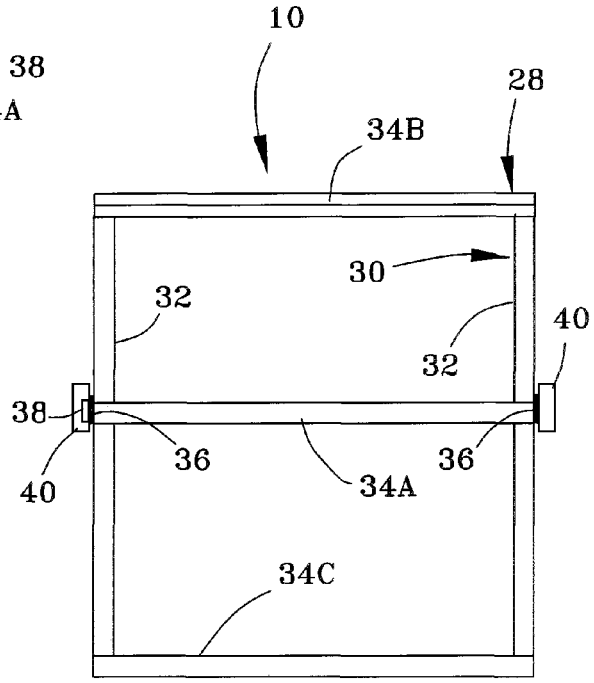
FIGS. 3 and 4 are front and top views, respectively, of the anti-theft device of FIGS. 1 and 2.
Figure 4:
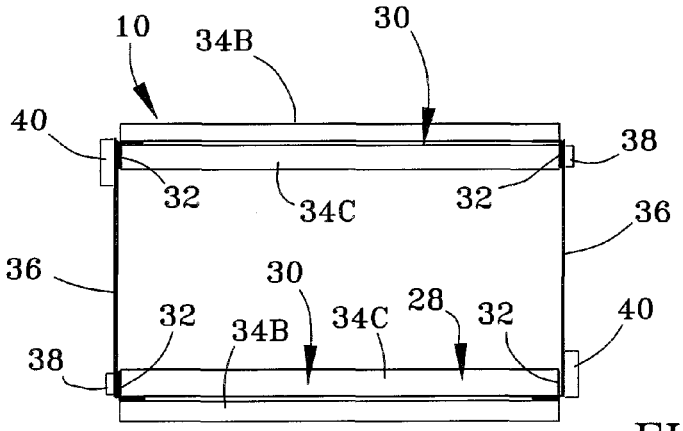

The frame units 30 are shown as being connected together and secured to the cabinet 13 with additional cross-members 36 located at each of the narrower sides of the cabinet 13. As evident from FIGS. 1 and 2, the frame units 30 are assembled onto the cabinet 13 so that the cross-members 34A-C extend across the wider sides of the cabinet 13, and at least the cross-members 34B extend across the doors 16 located on the wider sides of the cabinet 13 to effectively prevent their opening. FIGS. 1, 2 and 3 depict each cross-member 36 as being formed of flatstock and configured as a locking cross-member. In the embodiment shown, each locking cross-member 36 is pivotally attached with a bolt 38 to a leg 32 of one of the frame units 30, such that each unit 30 has a locking cross-member 36 attached thereto. At its end opposite the bolt 38, each locking cross-member 36 is equipped with a locking device 40 to enable the locking cross-member 36 to be locked to a leg 32 of the other frame unit 30, thus preventing the frame assembly 28 from being laterally removed from the cabinet 13. The locking mechanism 40 can be of any suitable type, including but not limited to a padlock whose shackle passes through alignable holes (not shown) on the locking cross-member 36 and on a bracket (not shown) attached to the leg 32 to which the cross-member 36 is locked with the mechanism 40. Access to the interior of the cabinet 13 is achieved by unlocking the locking mechanisms 40 to enable the locking cross-members 36 to be uncoupled from the legs 32, and then separating the frame units 30 to permit opening of either cabinet door 16 held closed by either unit 30. As such, without a key, combination, etc., for unlocking the locking mechanism 40, the interior of the cabinet 13 cannot be accessed and fuel cannot be illegally obtained by damaging the dispenser metering components within the dispenser cabinet 13.

As evident from FIGS. 1 and 2, lifting of the frame assembly 28 off the cabinet 13 is prevented as a result of the cross-members 34A extending across the wider sides of the cabinet 13 directly below the fuel nozzle carriages 24 (one of which is shown). Optionally, lifting of the frame assembly 28 can also be prevented by engaging the lower margin 20 of the cabinet 13 with the lower cross-members 34C, as shown in FIG. 2. The angle stock used to form the legs 32 also cover the vertical corners of the cabinet 13 to further assist in preventing the removal of the panels 14 and doors 16 of the cabinet 13.

While the invention has been described in terms of a specific embodiment, it is apparent that other forms could be adopted by one skilled in the art. For example, the functions of certain components of the anti-theft device 10 could be performed by components of different construction but capable of a similar (though not necessarily equivalent) function, the frame assembly 28 and its components could differ in appearance and construction from the embodiment shown in the figures, and appropriate materials could be substituted for those noted. Accordingly, the scope of the invention is to be limited only by the following claims.

The invention claimed is:

1. An anti-theft device and a fuel dispenser cabinet on which the anti-theft device is installed to secure and prevent access to components within an interior of the fuel dispenser cabinet, the fuel dispenser cabinet being secured to a foundation and having upper and lower margins, sides defining a periphery and vertical corners of the fuel dispenser cabinet, an access door located in a first side of the sides of the fuel dispenser cabinet, and a fuel nozzle carriage located on the first side above the access door, the anti-theft device comprising:

first and second frame units, each of the first and second frame units comprising vertical legs joined by a first cross-member oriented transverse to the vertical legs, the first cross-member of the first frame unit being positioned beneath the fuel nozzle carriage and across the access door and preventing access to the interior of the fuel dispenser cabinet through the access door; and releasable means for selectively allowing and preventing access to the interior of the fuel dispenser cabinet through the access door, the releasable means comprising means for securing the first and second frame units together so that the anti-theft device surrounds the periphery of the fuel dispenser cabinet, the first cross-member of the first frame unit is positioned beneath the fuel nozzle carriage and across the access door, and the vertical legs and the first cross-members prevent the anti-theft device from being laterally and vertically removed from the fuel dispenser cabinet.

2. The anti-theft device and the fuel dispenser cabinet according to claim 1, wherein the first and second frame units are installed on, respectively, the first side of the fuel dispenser cabinet and on a second side of the sides of the fuel dispenser cabinet opposite the first side, and the securing means of the releasable means comprises a second cross-member that is disposed on a third side of the sides of the fuel dispenser cabinet and couples the first and second frame units together.

3. The anti-theft device and the fuel dispenser cabinet according to claim 2, wherein:

the second cross-member has a first end pivotably coupled to the first frame unit and a second end releasably coupled to the second frame unit; and the releasable means further comprises means for locking the second end of the second cross-member to the second frame unit.

4. The anti-theft device and the fuel dispenser cabinet according to claim 1, wherein the anti-theft device is prevented from being lifted off the fuel dispenser cabinet by the first cross-member positioned beneath the fuel nozzle carriage of the fuel dispenser cabinet.

5. The anti-theft device and the fuel dispenser cabinet according to claim 1, wherein the first cross-member engages the lower margin of the fuel dispenser cabinet to prevent the anti-theft device from being lifted off the fuel dispenser cabinet.

6. The anti-theft device and the fuel dispenser cabinet according to claim 1, wherein each of the first and second frame units has a solid one-piece construction.

7. The anti-theft device and the fuel dispenser cabinet according to claim 1, wherein the vertical legs are positioned at and cover at least portions of the vertical corners of the fuel dispenser cabinet associated with a corresponding one of the first and second sides of the fuel dispenser cabinet.

8. The anti-theft device and the fuel dispenser cabinet according to claim 1, wherein the securing means of the releasable means comprises:

a first locking cross-member that is pivotally coupled at a first end thereof to a first of the vertical legs of the first frame unit and releasably coupled at a second end thereof to a first of the vertical legs of the second frame unit so that the first locking cross-member is disposed on a third side of the sides of the fuel dispenser cabinet and couples the first and second frame units together; and a second locking cross-member that is pivotally coupled at a first end thereof to a second of the vertical legs of the second frame unit and releasably coupled at a second end thereof to a second of the vertical legs of the first frame unit so that the second locking cross-member is disposed on a fourth side of the sides of the fuel dispenser cabinet and couples the first and second frame units together.

9. The anti-theft device and the fuel dispenser cabinet according to claim 1, wherein the first and second frame units are installed on, respectively, the first side of the fuel dispenser cabinet and on a second side of the sides of the fuel dispenser cabinet opposite the first side, and the securing means of the releasable means comprises first and second locking cross-members that are disposed on, respectively, a third side of the sides of the fuel dispenser cabinet and on a fourth side of the sides of the fuel dispenser cabinet opposite the third side.

10. An anti-theft device adapted to secure and prevent access to components within an interior of a fuel dispenser cabinet having sides that define a periphery and vertical corners of the fuel dispenser cabinet and further having an access door located in a first side of the sides of the fuel dispenser cabinet, the anti-theft device comprising:

first and second frame units adapted and configured to be assembled together so that, when the anti-theft device is installed on the fuel dispenser cabinet, the first and second frame units are installed on, respectively, the first side of the fuel dispenser cabinet and on a second side of the sides of the fuel dispenser cabinet opposite the first side, each of the first and second frame units comprising vertical legs joined by a first cross-member oriented transverse to the vertical legs thereof, the vertical legs being adapted and configured to cover the corners of the fuel dispenser cabinet from one of the first and second sides thereof to one of oppositely-disposed third and fourth sides of the sides of the fuel dispenser cabinet between the first and second sides of the fuel dispenser cabinet, each of the first and second frame units having a solid one-piece construction; and releasable means for selectively coupling and uncoupling the first and second frame units to respectively allow and prevent access to the interior of the fuel dispenser cabinet through the access door, the releasable means comprising first and second locking cross-members adapted and configured to secure the first and second frame units together and enable the anti-theft device to surround the periphery of the fuel dispenser cabinet, each of the first and second locking cross-members being pivotally coupled at a first end thereof to one of the vertical legs of one of the first and second frame units and adapted to be releasably coupled at a second end thereof to another of the vertical legs of the other of the first and second frame units so that the first and second locking cross-members are disposed on the oppositely-disposed third and fourth sides of the fuel dispenser cabinet.

11. A method of installing the anti-theft device of claim 1 on the fuel dispenser cabinet of claim 1 to secure and prevent access to the components within the interior of the fuel dispenser cabinet, the method comprising:

installing the first and second frame units on the fuel dispenser cabinet so that the anti-theft device surrounds the periphery of the fuel dispenser cabinet and the first cross-member of the first frame unit is positioned beneath the fuel nozzle carriage and across the access door located on the first side of the fuel dispenser cabinet; and operating the securing means of the releasable means to secure the first and second frame units together so that the anti-theft device surrounds the periphery of the fuel dispenser cabinet, the anti-theft device is prevented from being laterally and vertically removed from the fuel dispenser cabinet, and the first cross-member of the first frame unit is positioned beneath the fuel nozzle carriage and across the access door to prevent access to the interior of the fuel dispenser cabinet through the access door located on the first side of the fuel dispenser cabinet.

12. The method according to claim 11, wherein the operating step comprises pivoting a second cross-member that is pivotally coupled at a first end thereof to a first of the vertical legs of the first frame unit and coupling a second end of the second cross-member to a first of the vertical legs of the second frame unit so that the second cross-member couples the first and second frame units together.

13. The method according to claim 12, wherein the operating step further comprises locking the second end of the second cross-member to the first of the vertical legs of the second frame unit.

14. The method according to claim 12, wherein the operating step further comprises:

pivoting a third cross-member that is pivotally coupled at a first end thereof to a second of the vertical legs of the second frame unit and coupling a second end of the third cross-member to a second of the vertical legs of the first frame unit so that the second cross-member couples the first and second frame units together; and locking the second end of the third cross-member to the second of the vertical legs of the first frame unit.

15. The method according to claim 11, wherein the securing step comprises:

pivoting a first locking cross-member that is pivotally coupled at a first end thereof to a first of the vertical legs of the first frame unit so that the first locking cross-member pivots across a third side of the sides of the fuel dispenser cabinet;

releasably coupling a second end of the first locking cross-member to a first of the vertical legs of the second frame unit so that the first locking cross-member couples the first and second frame units together;

pivoting a second locking cross-member that is pivotally coupled at a first end thereof to a second of the vertical legs of the second frame unit so that the second locking cross-member pivots across a fourth side of the sides of the fuel dispenser cabinet; and releasably coupling a second end of the second locking cross-member to a second of the vertical legs of the first frame unit so that the second locking cross-member couples the first and second frame units together.

16. A method of securing and preventing access to components within an interior of a fuel dispenser cabinet secured to a foundation, the fuel dispenser cabinet having upper and lower margins, sides defining a periphery and vertical corners of the fuel dispenser cabinet, an access door located in a first side of the sides of the fuel dispenser cabinet, and a fuel nozzle carriage located on the first side above the access door, the method comprising:

providing an anti-theft device comprising first and second frame units, the first and second frame units each comprising vertical legs joined by a first cross-member oriented transverse to the vertical legs thereof;

placing the first and second frame units at, respectively, the first side of the fuel dispenser cabinet and a second side of the sides of the fuel dispenser cabinet opposite the first side so that the anti-theft device surrounds the periphery of the fuel dispenser cabinet and the first cross-member of the first frame unit is positioned beneath the fuel nozzle carriage and across the access door located on the first side of the fuel dispenser cabinet; and securing the first and second frame units together so that the vertical legs and the first cross-members of the first and second frame units prevent the anti-theft device from being laterally and vertically removed from the fuel dispenser cabinet and the first cross-member of the first frame unit is positioned beneath the fuel nozzle carriage and across the access door to prevent access to the interior of the fuel dispenser cabinet through the access door located on the first side of the fuel dispenser cabinet.

17. The method according to claim 16, wherein the securing step comprises pivoting a second cross-member that is pivotally coupled at a first end thereof to a first of the vertical legs of the first frame unit and coupling a second end of the second cross-member to a first of the vertical legs of the second frame unit so that the second cross-member couples the first and second frame units together.

18. The method according to claim 17, wherein the securing step further comprises locking the second end of the second cross-member to the first of the vertical legs of the second frame unit.

19. The method according to claim 17, wherein the securing step further comprises:

pivoting a third cross-member that is pivotally coupled at a first end thereof to a second of the vertical legs of the second frame unit and coupling a second end of the third cross-member to a second of the vertical legs of the first frame unit so that the second cross-member couples the first and second frame units together; and locking the second end of the third cross-member to the second of the vertical legs of the first frame unit.

20. The method according to claim 16, wherein the securing step comprises:

pivoting a first locking cross-member that is pivotally coupled at a first end thereof to a first of the vertical legs of the first frame unit so that the first locking cross-member pivots across a third side of the sides of the fuel dispenser cabinet;

releasably coupling a second end of the first locking cross-member to a first of the vertical legs of the second frame unit so that the first locking cross-member couples the first and second frame units together;

pivoting a second locking cross-member that is pivotally coupled at a first end thereof to a second of the vertical legs of the second frame unit so that the second locking cross-member pivots across a fourth side of the sides of the fuel dispenser cabinet; and releasably coupling a second end of the second locking cross-member to a second of the vertical legs of the first frame unit so that the second locking cross-member couples the first and second frame units together.

* * * * *